US012385198B2

(12) United States Patent
Ball

(10) Patent No.: US 12,385,198 B2
(45) Date of Patent: Aug. 12, 2025

(54) BOLLARDS AND BARRIERS

(71) Applicant: ATG Access Ltd, Merseyside (GB)

(72) Inventor: Robert Nicholas Ball, Merseyside (GB)

(73) Assignee: ATG ACCESS LTD, Merseyside (GB)

( * ) Notice: Subject to any disclaimer, the term of this patent is extended or adjusted under 35 U.S.C. 154(b) by 814 days.

(21) Appl. No.: 17/247,772

(22) Filed: Dec. 22, 2020

(65) Prior Publication Data

US 2021/0189671 A1 Jun. 24, 2021

(30) Foreign Application Priority Data

Dec. 24, 2019 (GB) ..... 1919270

(51) Int. Cl.
*E01F 15/00* (2006.01)
*E01F 15/14* (2006.01)

(52) U.S. Cl.
CPC ..... *E01F 15/003* (2013.01); *E01F 15/14* (2013.01)

(58) Field of Classification Search
CPC ..... E01F 15/003; E01F 15/14
See application file for complete search history.

(56) References Cited

U.S. PATENT DOCUMENTS 4,973,189 A * 11/1990 Bechtold ..... E01F 15/003 220/8
5,186,438 A * 2/1993 Cross ..... E01F 9/669 403/294
8,277,143 B2 * 10/2012 Adler ..... E01F 13/12 404/9
8,579,262 B2 * 11/2013 Sadinsky ..... E04H 17/009 256/26
8,864,108 B2 * 10/2014 James ..... E01F 15/088 256/19
9,127,421 B2 * 9/2015 Ball ..... E01F 15/003
(Continued)

FOREIGN PATENT DOCUMENTS

DE 202017004424 U1 * 11/2017
GB 2485278 5/2012
(Continued)

OTHER PUBLICATIONS

Great Britain Application No. GB 1919270.7 Search Report dated Jun. 18, 2020.

*Primary Examiner* — Christopher J Sebesta
*Assistant Examiner* — Katherine J Chu
(74) *Attorney, Agent, or Firm* — Gottlieb, Rackman & Reisman, PC

(57) ABSTRACT

A bollard apparatus for use as a vehicle barrier includes: a plurality of bollard members; a plurality of separate foot members adapted for ground engagement by placement upon or embedment within a surface, one or more of which is attached to at least one bollard member upstanding therefrom, wherein at least one foot member includes: a front edge; a rear edge; at least one lateral edge which opposes a corresponding lateral edge of a neighbouring foot member, wherein at least one lateral edge extends between the front and rear edges and is non-planar so as to include: a first edge part; and, a second edge part that is laterally offset from the first edge part, wherein the bollard apparatus further includes a coupling assembly which couples the foot member to the neighbouring foot member, wherein the coupling assembly is attached to the lateral edge.

20 Claims, 7 Drawing Sheets

(56) References Cited

U.S. PATENT DOCUMENTS

| | | | | |
|---|---|---|---|---|
| 9,133,590 | B2 * | 9/2015 | Ball | E01F 15/003 |
| 10,113,279 | B2 * | 10/2018 | Stevens | E01F 15/088 |
| 10,753,055 | B2 * | 8/2020 | Tosolini | E01F 13/12 |
| 11,479,933 | B2 * | 10/2022 | Stone | E01F 15/08 |
| 11,613,858 | B2 * | 3/2023 | Ball | E01F 13/02 404/6 |
| 2007/0206990 | A1 * | 9/2007 | Yodock, III | E01F 15/083 404/6 |
| 2010/0303545 | A1 * | 12/2010 | Severgnini | E01F 15/086 404/6 |
| 2021/0363716 | A1 * | 11/2021 | Daniluk | F41H 5/24 |

FOREIGN PATENT DOCUMENTS

| | | | | | |
|---|---|---|---|---|---|
| GB | 2490118 | | | 10/2012 | |
| GB | 2498923 | A | * | 8/2013 | E01F 13/028 |
| KR | 19990012984 | U | * | 4/1999 | |
| WO | 2009/023121 | | | 2/2009 | |
| WO | 2012/101451 | | | 8/2012 | |
| WO | WO-2020037379 | A1 | * | 2/2020 | E01F 15/003 |

* cited by examiner

BOLLARDS AND BARRIERS

FIELD

The present invention relates to bollards and particularly, though not exclusively, to surface-mountable bollards, or to bollards for shallow embedment in the ground, for use as vehicle impact barriers.

BACKGROUND

The provision of barriers comprising bollards, particularly vehicle barriers, often requires the permanent fixture, embedding or foundation of bollards within a ground surface in order to provide sufficient robustness and resilience of permanency to the barrier. Typically, the bollards of such a barrier are mechanically coupled, neighbour-to-neighbour, to achieve an integrated barrier system particularly when used as a vehicle impact barrier.

The coupled bollards of such a vehicle impact barrier provide the interface between the barrier and an impacting vehicle via which impact forces/loads are transferred into the barrier as a whole, from the vehicle. Accordingly, the greater the number of coupled bollards of the barrier that can be involved in this load transfer process, during a given vehicular impact event, the better. This is because the barrier is better able to distribute the impact loads across a greater proportion of the barrier as a whole if the initial points of vehicle impact are already at least to some extent distributed between two or more bollards of the barrier.

However, such vehicle impact barriers are required to be arranged so that the bollards of the barrier form a linear array, at least in part. Whereas an impact from a vehicle travelling in a direction perpendicular to the linear array may impact one or more bollards at once, an oblique impact is more likely to impact several bollards as the vehicle crumples around an initial contacting bollard and proceeds onto a second bollard. As a result, single or multiple bollards of the barrier may be required to bear the burden of transferring all of the impact forces/loads from the impacting vehicle into the barrier as a whole. This places severe strains on the coupling between the impacted bollard and its neighbouring bollards, and can result in failure of the barrier.

The present invention aims to provide means and methods which may be used desirably to assist in addressing some or all of the problems identified above.

SUMMARY

The present invention provides a bollard apparatus and a bollard unit according to the appended claims.

Disclosed herein is a bollard apparatus for use as a vehicle barrier. The bollard apparatus may comprise: a plurality of bollard members; a plurality of separate foot members each adapted for ground engagement by placement upon or embedment within a ground or floor surface, to one or more of which is attached at least one said bollard member upstanding therefrom.

The at least one said foot member may comprise: a front edge; a rear edge; at least one lateral edge which opposes a corresponding lateral edge of a neighbouring foot member of the plurality of foot members, wherein the at least one lateral edge extends between the front and rear edges and is non-planar. The non-planar construction of the lateral edge may comprise: a first edge part thereof; and, a second edge part thereof that is laterally offset from the first edge part, wherein the bollard apparatus further comprises a coupling assembly which couples the foot member to the neighbouring said foot member, wherein the coupling assembly is attached to the lateral edge.

The lateral offset may be in relation to the width of the foot member. The width of the foot member may be defined by the length of the front and/or rear edges. Thus, the lateral offset may position the first edge part or the second edge part closer to a centre line of a bollard unit or bollard member when viewed from the front or rear thereof. The front edge may be defined in relation to a vehicle side of the bollard apparatus/barrier. The rear edge may be defined in relation to a protected side of the bollard apparatus/barrier. The bollard apparatus may be referred to as a barrier. The barrier may comprise a plurality of bollard units provided in a series arrangement (e.g. a train).

The lateral edge may define a line between the foot member and the neighbouring foot member and line is non-linear. The at least one lateral edge has a curved or stepped profile. The stepped profile may be staggered or meandering so as to include one or more angularly offset sections.

The first and second edge parts may be interleaved with the corresponding lateral edge of the neighbouring foot member or an intermediate foot member. The interleaving may be with reference to a plan view or a cross sectional view in which one or more portions of the foot members overlap each other or are interdigitated. The opposing lateral edges may for a tongue and groove arrangement or a lapped joint arrangement when viewed in plan or through thickness cross section. The non-linear edge may provide a broken fulcrum between the two neighbouring foot members.

The intermediate member may be separate from the plurality of foot members. Thus, the intermediate member may be a plate which is located between the neighbouring foot members and provides a bridge in the coupling between adjacent foot members.

The lateral edge(s) of the foot members may comprise a third edge part which extends between the first edge part and second edge part, wherein the coupling is attached to the third edge part. Thus, the foot members may comprise a first edge part and a second edge part which face the neighbouring foot members (e.g. generally along the length of the barrier) and an intermediate/third edge part which faces forward or rearwards (e.g. towards or away from the front edge). The third edge part may extend in the same direction as the front or rear edge.

The at least one lateral edge may stepped along the length between the front and rear edges and/or where the foot member comprises a thickness, the at least one edge may be stepped across the thickness of the foot member.

The coupling assembly may comprise a plurality of couplings which pass through the thickness of the foot member and the neighbouring member.

The coupling assembly may be configured to couple the foot member and neighbouring foot member in one of a plurality of discrete positions. Thus, neighbouring foot members may be attached to each other in one of plurality of different positions such that the line of the barrier may be staggered or curved. Each of the plurality of discrete positions may provide a different angle of alignment between the foot member and the neighbouring foot member.

The first edge part and second edge part may be orthogonally arranged. The first edge part and/or second edge part may be orthogonal with respect to the front or rear edge. The lateral edge may be generally perpendicular in part to the front and/or rear edge, and/or line of the barrier.

The foot member may comprise a planar structure. The lateral edge comprises a peripheral edge of the planar structure. The planar structure may be a plate. The planar structure may be provided by a plurality of plates arranged in a stacked configuration.

The rear edge may comprise an extension which projects beyond the line of the neighbouring foot plate. The rear extension may be provided on a terminal end of the barrier. Thus, the foot member may comprise the extension may be an end foot member provided at the end of a line of the plurality of foot members. The rear extension may provide an increased depth to the terminal end.

The coupling assembly may comprises an articulating coupling assembly which couples the foot member to the neighbouring said foot member in an articulating manner.

The bollard apparatus may comprise a plurality of separate coupling assemblies each forming an articulating coupling between neighbouring said foot members whereby, by said articulating coupling, each said foot member is coupled: at a first edge part thereof to an opposing first edge part of said neighbouring foot member such that said first edge parts define a first pair of coupled opposing edge parts; at a second edge part thereof to an opposing second edge part of said neighbouring foot member such that said second edge parts define a second pair of coupled opposing edge parts, wherein the first pair of coupled opposing edge parts is laterally offset from the second pair of coupled opposing edge parts in a direction transverse to the direction in which a said first edge part extends.

The first edge part of at least one foot member may be laterally offset from the second edge part of that at least one foot member by a lateral offset exceeding the maximum separation between the opposing edge parts of the first pair of coupled opposing edge parts permitted by the articulated coupling.

At least one coupling assembly may comprise two terminal ends each one of which is attached to a respective one of said opposing edge parts coupled thereby.

The front edge may be proximal to the bollard member relative to the distal rear edge.

At least one coupling assembly may comprise a cable or a wire or a chain or a rope or a cord, or a rigid loop, or an articulated rigid plate, or a hinge, or any combination thereof.

It will be appreciated that the bollard apparatus described herein comprises a plurality of bollard units which are attached together via the coupling assembly and/or one or more intermediate members. Hence, disclosed herein is a bollard unit comprising: one or more bollard members; a foot member adapted for ground engagement by placement upon or embedment within a ground or floor surface, to which is attached the one or more bollard members upstanding therefrom, wherein at least one said foot member comprises: a front edge; a rear edge; at least one non-planar lateral edge which, in use, opposes a corresponding lateral edge of a neighbouring foot member of the plurality of foot members, wherein the at least one lateral edge extends between the front and rear edges and is non-planar so as to comprise: a first edge part thereof; and, a second edge part thereof that is laterally offset from the first edge part, wherein the first edge part or second edge part is adapted to receive a coupling assembly for coupling the lateral edge to a neighbouring foot member in use.

Also disclosed herein is a kit of parts for a bollard apparatus or bollard units described herein.

Also disclosed herein is a bollard apparatus for use as a vehicle barrier comprising: a plurality of bollard members; a plurality of separate foot members each adapted for ground engagement by placement upon or embedment within a ground or floor surface, to one or more of which is attached at least one said bollard member upstanding therefrom, wherein at least one said foot member comprises: a first edge part thereof (e.g. peripheral edge); and, a second edge part thereof (e.g. peripheral edge) that is laterally offset from the first edge; part the apparatus further comprising a coupling assembly which couples the foot member to the neighbouring said foot member at a location between the first edge and the second edge; whereby the second edge part impedes impact-induced pivoting movement of the at least one foot member relative to said neighbouring foot member about said coupling assembly.

Accordingly, the above bollard apparatuses provide an off-setting of the lateral edges (e.g. peripheral edges) of a foot member relative to the bollard member fixed to it, has the advantage that the second edge (further from the bollard) may act as an 'anti-tipple' foot part to resist the flipping of the foot part when impacted by a vehicle striking the bollard at an angle oblique to the line of the bollard array, with the bollard between the vehicle and the second edge. Furthermore, the relative positioning of the coupling of the foot member to its neighbouring foot member, much more efficiently resists turning forces (i.e. which may otherwise induce the foot member to 'flip-over'), and much more efficiently transfers those loads to a neighbouring foot member via the coupling assembly. This is because the onset of a pivoting movement of the foot member is likely to turn around/about the second edge of the foot part when impacted by a vehicle striking the bollard at an angle oblique to the line of the bollard array, with the bollard between the vehicle and the second edge, and this turning is resisted or impeded by the coupling assembly (e.g. located 'between' the bollard and the second edge, in the lateral direction) which would be 'lifted' by the turning effect and in doing so would also urge to 'lift' the edge of the neighbouring foot member to which it is coupled. Of course, the lifting of the edge of the neighbouring foot member is impeded by the weight and/or forces holding that neighbouring foot member in place. This makes the barrier much more resistant to failure due to a vehicle striking the bollard at an angle oblique to the line of the bollard, especially when vehicular impact forces are imparted to a sole bollard of an array of bollards of the barrier.

The term 'edge' may refer to a peripheral edge, a terminal edge, a bounding edge, perimeter edge, or a border edge of a foot member. Desirably, the first edge part and the second edge part are separate parts of one continuous edge of a said foot member. A foot member may comprise a rigid body such as a plate (e.g. steel), or may comprise a rigid assembly of beams/bars etc., presenting a solid and continuous edge containing the first and second edge parts, and any intermediate edge parts joining the first and second edge parts. This assists in providing a strong edge for coupling to and for bearing impact loads.

The first edge part may be adjacent to an opposing first edge part of a neighbouring foot member of said plurality of separate foot members. The first and second edges of one foot part may be reciprocally mirrored by opposing first and second edges of a neighbouring foot part. This assists in efficient side-by-side positioning of foot member in a barrier.

A second edge part thereof may be laterally offset from the first edge such that the second edge of the foot member is further from at least one bollard member thereof than is the first edge part of the foot member. This allows the second edge to achieve as greater lever/fulcrum to resist tipping of the foot member when the bollard member receives a vehicle impact force transverse to it.

The first edge part and the second edge part of at least one foot member may each be configured to extend in a direction transverse to the longitudinal axis of a bollard member of the plurality of bollard members. For example, the edges in question may extend generally horizontally, e.g. across the ground surface, in use.

The first edge part and the second edge part of at least one foot member may each be configured to extend in a direction substantially parallel to the longitudinal axis of a bollard member of the plurality of bollard members. For example, the edges in question may extend generally vertically, e.g. upwardly from the ground surface, in use. Indeed, a combination of both horizontal and vertical edge arrangements may be used. Both may provide the resistance to impact-induced tipping described above.

The coupling assembly may couple the foot member to the neighbouring said foot member at a location between the first edge and the second edge and at or adjacent to the opposing first edge. The location may be between the bollard and the second edge, in the lateral direction. The coupling assembly may be an articulating coupling assembly which couples the foot member to the neighbouring said foot member in an articulating manner. This articulation has the advantage that it may be such as to permit some articulation of one foot member relative to its neighbour to a desired small extent, appropriate to circumstances at hand, which is useful in allowing initial impact loads from a vehicle to be transferred to the barrier via a limited upward turning of the foot member, but after whish further upward turning is resisted. This avoids the barrier being too 'stiff' and 'brittle' in response to vehicle impact, while also being resistant to a foot member being flipped over by that impact.

The bollard apparatus may comprise a plurality of separate coupling assemblies each forming an articulating coupling between neighbouring said foot members such that impact forces inducing movement in one coupled foot member are transmissible to said neighbouring coupled foot member via a said articulating coupling whereby, by said articulating coupling, each said foot member is coupled: at a first edge thereof to an opposing first edge of said neighbouring foot member such that said first edges define a first pair of coupled opposing edges; at a second edge thereof to an opposing second edge of said neighbouring foot member such that said second edges define a second pair of coupled opposing edges; wherein the first pair of coupled opposing edges is laterally offset from the second pair of coupled opposing edges in a direction transverse to the direction in which a said first edge extends. This has the advantage that the first and second edges, while still permitting some appropriate flexure of the barrier are also efficient at transferring impact loads 'along' the line of the barrier, between neighbouring foot members.

For example, the bollard apparatus may comprise a plurality of bollard members; a plurality of separate foot members each adapted for ground engagement by placement upon or embedment within a ground or floor surface, to each of which is fixed at least one said bollard member upstanding therefrom; a plurality of separate coupling assemblies each forming an articulated coupling between neighbouring said foot members such that impact forces inducing movement in one coupled foot member are transmissible to said neighbouring coupled foot member via a said articulated coupling; whereby, by said articulated coupling, each said foot member is coupled: at a first edge thereof to an opposing first edge of said neighbouring foot member such that said first edges define a first pair of coupled opposing edges; at a second edge thereof to an opposing second edge of said neighbouring foot member such that said second edges define a second pair of coupled opposing edges; wherein the first pair of coupled opposing edges is laterally offset from the second pair of coupled opposing edges in a direction transverse to the direction in which a said first edge extends.

The first edge of a said coupled foot member may extends in a direction which is substantially parallel to a direction in which said second edge thereof extends. This may be in a 'dog-leg' profile which also allows an opposing, reciprocal 'dog-leg' edge profile to 'fit' adjacent the edges in question allowing a compact and spatially efficient arrangement on the barrier.

The first edge may extend substantially parallel to said opposing first edge, and/or said second edge is substantially parallel to said opposing second edge. The first and second edges may each be substantially linear. The first and second edges may be joined by an intermediate edge (e.g. peripheral edge, e.g. linear) of the foot member which extends in a direction substantially perpendicular to one or both of the first and second edges.

The first edge of at least one foot member may be laterally offset from the second edge of that at least one foot member by a lateral offset exceeding the maximum separation between the opposing edges of the first pair of coupled opposing edges permitted by the articulated coupling. An advantage of this arrangement is that the second edge is constrained to be 'behind' the opposing first edge of the neighbouring foot member, in the lateral direction, such that an upward 'tipping' of the foot member about its second edge, induced by a vehicle impact, also induces a corresponding upward lifting of the first edge and an upward lifting force to the opposing first edge of the neighbouring foot member via the coupling between them. This resists/impedes the foot member being 'tipped over' by a vehicle impacting the bollard fixed to it.

Each opposing edge of the first pair of opposing edges may be laterally offset from each opposing edge of the second pair of opposing edges.

An aforementioned lateral offset may be an offset in a direction substantially parallel to a direction along which a said bollard of the foot member is separated from a said bollard of the neighbouring foot member. An aforementioned lateral offset may be an offset in a direction substantially transverse to a direction along which a said bollard of the foot member extends from the foot member. In other words, preferably, the lateral offset is in the general direction along which the barrier extends.

At least one said coupling assembly may be attached to each of the said opposing edges coupled thereby.

The at least one coupling assembly may comprise two terminal ends each one of which is attached to a respective one of said opposing edges coupled thereby.

The at least one coupling assembly may extend between no more than two said foot members.

An aforementioned foot member may extend in a direction transverse to the bollard(s) fixed thereto from a proximal edge thereof to a distal edge thereof which is further from the bollard(s) than is the proximal edge, and the bollard(s) is upstanding from the foot member between said proximal edge and said distal edge, wherein a said coupling assembly extends from a lateral edge of said foot member which extends between said proximal edge and said distal edge. An advantage of this arrangement is that the barrier may be arranged such that the proximal edge of successive foot members of the barrier are resented, in unison, in the direction from which vehicle impact is expected. The portions of the foot member extending between the bollard and the distal edge of each such foot member thereby act as an 'anti-tipple' portion providing resistance to the foot member being tipped over the distal edge by impact forces applied transverse to the bollard on the direction towards the distal edge.

Successive separate foot members may be separated by a space containing separate said coupling assemblies of said plurality of coupling assemblies.

One some or each foot member may comprise a plate from a surface of which upper most in use said at least one bollard member stands substantially perpendicularly.

The at least one coupling assembly may comprise a cable or a wire or a chain or a rope or a cord, or a rigid loop, or an articulated rigid plate, or a hinge, or any combination thereof. The at least one coupling assembly may comprise a plurality of chains, ora plurality of articulated rigid loops, ora plurality of articulated rigid plates.

Optionally, each said separate foot member has only one respective bollard member fixed thereto.

The plurality of separate foot members may form an array of successive separate foot members substantially uniformly spaced and the bollard members of the array are also substantially uniformly spaced. One or more of the separate foot members may be formed from steel. One or more bollard member may comprise a metal bollard.

The profile of the lateral edge at one side of a foot member may reciprocate (i.e. be the inverse of) the profile of the lateral edge at the other side of the foot member. The bollard member is preferably located between these two lateral edges of the foot member. The separation between the opposing lateral edges may be substantially uniform for the length of the lateral edge.

The skilled person will appreciate that except where mutually exclusive, a feature described in relation to any one of the aspects, examples or embodiments described herein may be applied to any other aspect, example, embodiment or feature. Further, the description of any aspect, example or feature may form part of or the entirety of an embodiment of the invention as defined by the claims. Any of the examples described herein may be an example which embodies the invention defined by the claims and thus an embodiment of the invention.

It is intended that the apparatus of the invention may be made and sold in disassembled form, as a kit if parts. Thus, in a second aspect, the invention provides a kit of parts for a bollard apparatus as described in any aspect above.

BRIEF DESCRIPTION OF DRAWINGS

For the purposes of providing a better understanding of the invention, without intending to limit the scope of the invention, several examples of embodiments of the invention will now be described in the accompanying drawings of which.

DESCRIPTION OF EMBODIMENTS

Figure 1:
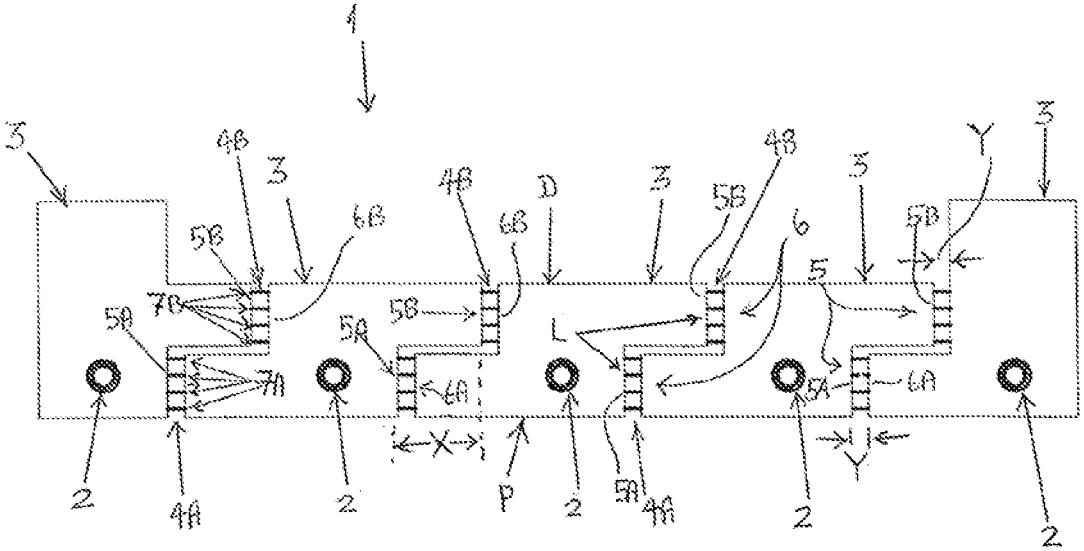
FIG. 1 shows a plan view of a vehicle impact barrier comprising foot member to which a respective bollard is fixed, in which a lateral edge of each foot member is staggered into two laterally offset edge parts.

In the drawings, like items are assigned like reference symbols.

Referring to FIG. 1, there is shown a plan view of a bollard apparatus 1 for use as a vehicle barrier. The barrier may comprise a plurality of separate bollard units which are attached together to provide an elongate train of bollard units which together define a barrier which demarcates a vehicle side and a protected side. A subset of the plurality of bollard units may be identical to adjacent bollard units in the bollard apparatus 1. The barrier may additionally comprise one or more end units which may differ from mid-bollard units.

Each bollard unit may include a one or more bollard members 2 which are fixed to a respective foot member 3. The bollards as shown as being centrally mounted on the foot members in the figures, but this is not a restriction and the bollards may be placed at any location across the width of the foot members. Each foot member 3 may be adapted for ground engagement by placement upon or embedment within a ground or floor surface. Each foot member 3 may extend in a direction transverse to the bollard such that the bollard member 2 extends from an upper surface of the foot member 3. Each foot member 3 may include a front edge and a rear edge which lie across the vehicle path which is to be blocked by the bollard apparatus 1. It will be appreciated that the terms front and rear edges are used nominally and interchangeably, however, typically, the front edge will face an expected direction of vehicle impact. Thus, the front edge may be define the exposed or vehicular side of the bollard unit, and the rear side the protected side, e.g. pedestrian side, of the bollard unit. The front edge may be referred to as a proximal edge P, with the rear side referred to as a distal edge, D, thereof. The rear distal edge D may further from the bollard than the proximal edge, P, such that more of the foot member extends behind the bollards and provides greater stability against an impacting vehicle.

Each bollard may be upstanding from the foot member in question, between the front and rear edges, and a coupling assembly may extend from a lateral edge, L, of a given foot member.

The lateral edge(s) 5, 6 may define a joint between adjacent foot members 3 which is non-linear such that the fulcrum between adjacent foot members 3 is broken. Providing a non-linear boundary line between neighbouring foot members 3 helps limit the vertical articulation which can occur between the neighbouring foot members 3 upon a vehicular impact. This is in contrast to a straight coupling line in which there is a defined fulcrum about which a bollard unit may pivot during an oblique vehicle impact. However, it will be appreciated that a certain amount of articulation is permitted by providing the distributed coupling line to account for uneven installation surfaces.

The lateral edge L may comprise a staggered or dog-leg configuration and extend between the proximal edge and said distal edge. Each foot member 3 may comprise a solid steel plate from a surface of which (uppermost in use) one bollard member 2 stands substantially perpendicularly. Each said separate foot member may have only one respective bollard member fixed thereto. The plurality of separate foot members form an array of successive separate foot members substantially uniformly spaced and the bollard members of the array may also be substantially uniformly spaced. One or more of the separate foot members may be formed from steel. One or more bollard member may comprise a metal bollard.

The vehicle barrier may also include a plurality of separate articulating coupling assemblies 4A, 4B each of which forms an articulating coupling between neighbouring foot members 3. It is via these articulating coupling assemblies that impact forces loaded on to one bollard member 2 may induce movement in one coupled foot member 3 which transmits a part of the impact load to a neighbouring coupled foot member 3 via an articulated coupling joining them. The articulated coupling may be provided at the lateral/side edges 5, 6 of each foot member.

The lateral/side edges may each be non-linear so as to be curved or stepped. The non-linear lateral edge may comprise a plurality of stepped portions or edge parts, each of which may provide an attachment of the coupling. In the example of FIG. 1, the non-linear lateral edge comprises two linear side edge parts 5A, 5B; 6A, 6B which extend in mutually parallel directions but which are laterally offset form each other in a direction X perpendicular to the direction in which they each extend. The direction of the side edge parts may be include intermediate edge parts, such as a third edge part which extends between the first and second edge parts. The intermediate edge parts may be parallel to the either of the front or rear edges. The intermediate edge parts may be orthogonally arranged with respect to the first and second edge parts. It will be appreciated that the terms first, second and third are used in a nominal sense and are not determinative of an order in which they must be presented on the foot member 3.

By the articulated coupling of a first articulating coupling assembly 4A, each said foot member is coupled at a first lateral/side edge part 5A of the foot member 3 to an opposing first lateral/side edge part 6A of a neighbouring foot member 3 such that these first edges define a first pair of coupled opposing lateral/side edge parts 5A, 6A. Similarly, by the articulated coupling of a second articulating coupling assembly 4B, each said foot member 3 is coupled at a second lateral/side edge part 5B thereof to an opposing second lateral/side edge part 6B of the neighbouring foot member such that these second lateral/side edge parts define a second pair of coupled opposing lateral/side edge parts 5B, 6B. Thus, the first pair of coupled opposing lateral/side edge parts 5A, 6A is laterally offset from the second pair of coupled opposing lateral/side edge parts 5B, 6B in a direction along the longitudinal axis of the barrier, this direction being transverse to the direction in which the first and second lateral/side edge parts and the opposing lateral/side edge parts each extend.

The first lateral/side edge part 5A may be substantially parallel to the opposing first lateral/side edge part 6A, and the second lateral/side edge part 5B may be substantially parallel to said opposing second lateral/side edge part 6B. Additionally, the first lateral/side edge part 5A of one foot member 3 may be laterally offset from the second lateral/side edge part 5B of that same foot member 3 by a lateral offset X exceeding the maximum separation Y between the opposing edges of the first and second pair of coupled opposing edges 5A, 6A; 5B, 6B permitted by the articulated coupling between them. In this arrangement, each opposing edge of the first pair of opposing edges is laterally offset from each opposing edge of the second pair of opposing edges.

An aforementioned lateral offset may be taken to be an offset in a direction substantially parallel to the line of the barrier, or a direction along which a bollard of the foot member is separated from a said bollard of the neighbouring foot member. The lateral offset may be an offset in a direction substantially transverse to a direction along which a said bollard of the foot member extends from the foot member.

Each coupling assembly 4A, 4B comprises four coupling sub-assemblies 7A, 7B each of which has two terminal ends. Each terminal end of an articulating coupling sub-assembly is attached to a respective one of the two opposing edges coupled by it. Each articulating coupling sub-assembly extends between no more than two neighbouring foot members. Successive separate foot members are separated by a space Y containing the separate articulating coupling sub-assemblies of the respective two articulating coupling assemblies. Any one or each coupling assembly may comprises a cable or a wire or a chain or a rope or a cord, or a rigid loop, or an articulated rigid plate, or a hinge, or any combination thereof. The at least one coupling assembly may comprise a flexible arrangement comprising one or more of a plurality of chains; a plurality of articulated rigid loops; and/or a plurality of articulated rigid plates.

Alternatively, the articulating coupling may comprise a hinge arrangement in which an articulation axle (e.g. a rod or pin, not shown) may pass through an axle bore formed within one foot member and through a corresponding axle bore in the neighbouring foot member, passing across the space between the foot members, to form a mutual axle about which either foot part may hinge relative to the other and subject to the limitation provided by the corresponding offset edge part. The articulation axle, and the axle bore, may be substantially parallel to the lateral/side edge parts of the two foot members.

The resultant construction provides a first edge of the foot member is provided adjacent to an opposing first edge of a neighbouring foot member, and a second edge thereof that is laterally offset from the first edge such that the second edge of the foot member is further from the bollard member thereof than is the first edge of the foot member. An articulating coupling assembly couples the foot member to the neighbouring foot member in an articulating manner at a location between the first edge and the second edge and at or adjacent to the opposing first edge. The result is that the second edge impedes impact-induced pivoting movement of the at least one foot member relative to said neighbouring foot member about the articulating coupling assembly. This assists in preventing the foot member from being flipped-over by oblique vehicular impact forces (i.e. oblique to the line of multiple bollards of the barrier).

The barrier may comprise one or more terminal ends which comprise bollard units which are configured differently to the mid-barrier bollard units. The end bollard units may only have a single neighbour and one corresponding non-planar lateral edge. The opposing, non-neighbour edge may comprise a linear edge. The non-neighbouring terminal edge may be linear, thereby extending in a straight line between the front and back edges of the bollard unit.

The terminal end bollard units may also include an additional "anti-tipple" feature in the form of a projection which extends from the rear edge of the bollard unit so as to provide an extension thereto. Thus, the depth of the terminal end bollard unit may be greater in extent between the front and rear edges then a mid-barrier bollard unit.

Figure 2:
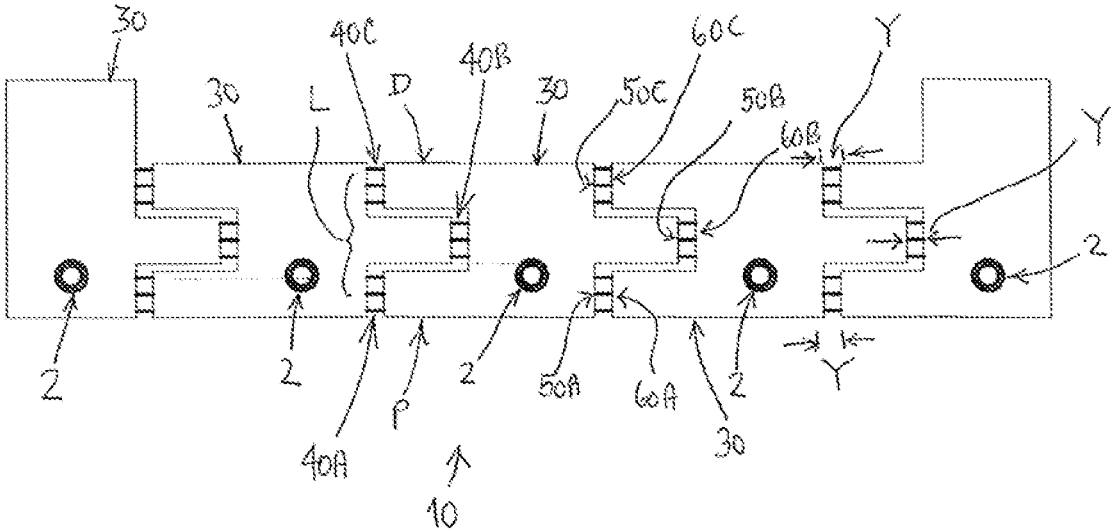
FIG. 2 shows a plan view of a vehicle impact barrier comprising foot member to which a respective bollard is fixed, in which a lateral edge of each foot member is staggered into three laterally offset edge parts.

The arrangement described in connection with FIG. 1 provides foot members 3 have non-planar, specifically non-linear, lateral edges which interleave with adjacent neighbouring foot members 3. It will be appreciated that the foot members 3 interleave when viewed in plan in the example of FIG. 1. FIG. 2 illustrates a plan view of a vehicle impact barrier comprising foot member to which a respective bollard is fixed, in which one lateral edge of each foot member 30, at one side of the bollard 2 fixed to it, is staggered into three laterally offset edge parts 50A, 50B and 50C resulting in a re-entrant slot, and in which one other lateral edge of each foot member, at the opposite side of the bollard 2, is staggered into three laterally offset edge parts 60A, 60B and 60C resulting in a tongue dimensioned to fit within the re-entrant slot presented by a neighbouring such foot member 3. Thus, there is a provided a tongue and groove formation when viewed in plan. The profile of the lateral edge at one side of the foot member reciprocates (i.e. the inverse of) the profile of the lateral edge at the other side of the foot member. Articulating coupling sub-assemblies 40A, 40B and 40C extend between opposing pairs of lateral edges of neighbouring foot members.

Figure 3:
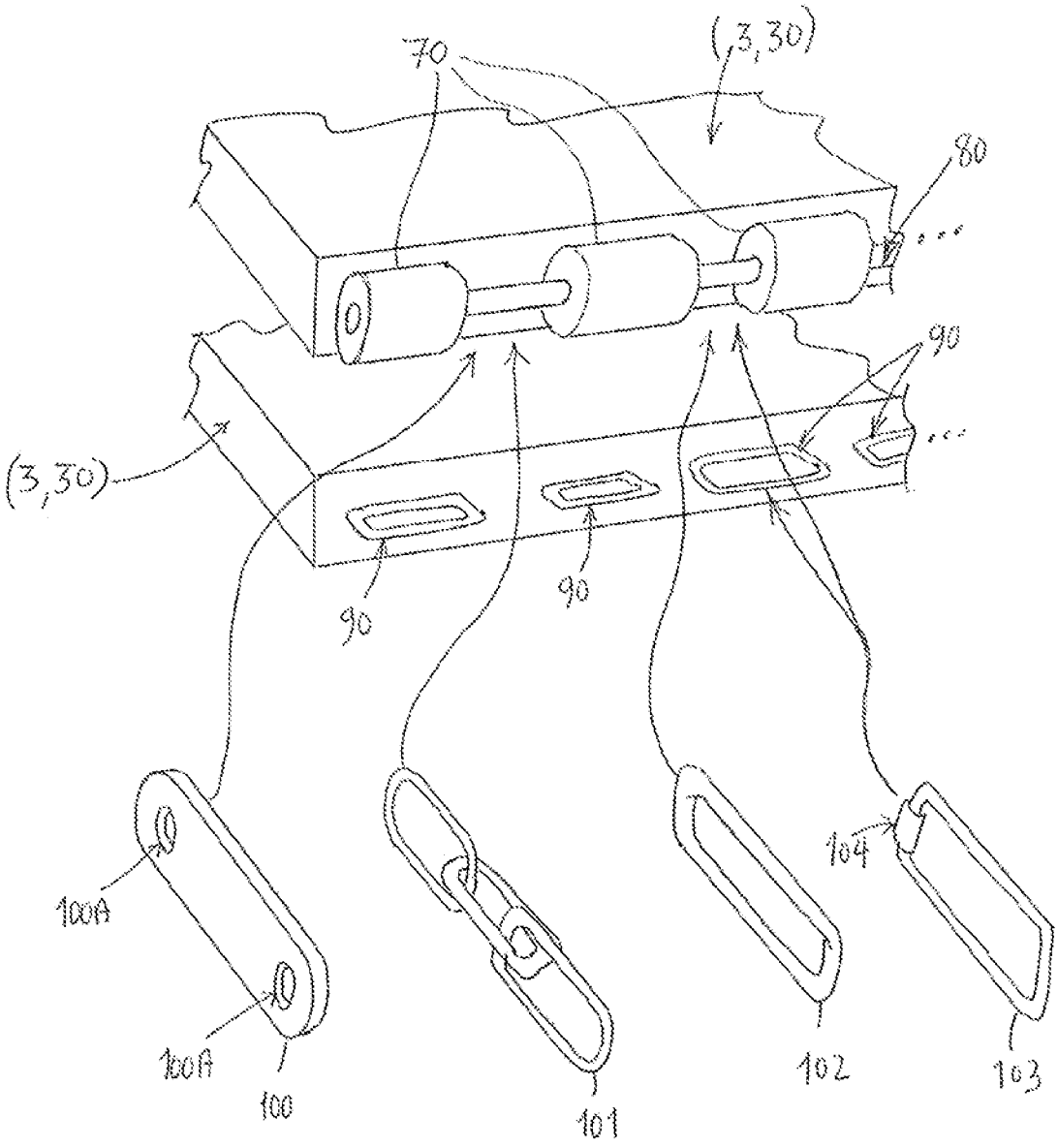
FIG. 3 shows a schematic view of various articulating coupling assemblies applicable to embodiments of the invention shown in FIGS. 1,2 and 4.
Figure 4:
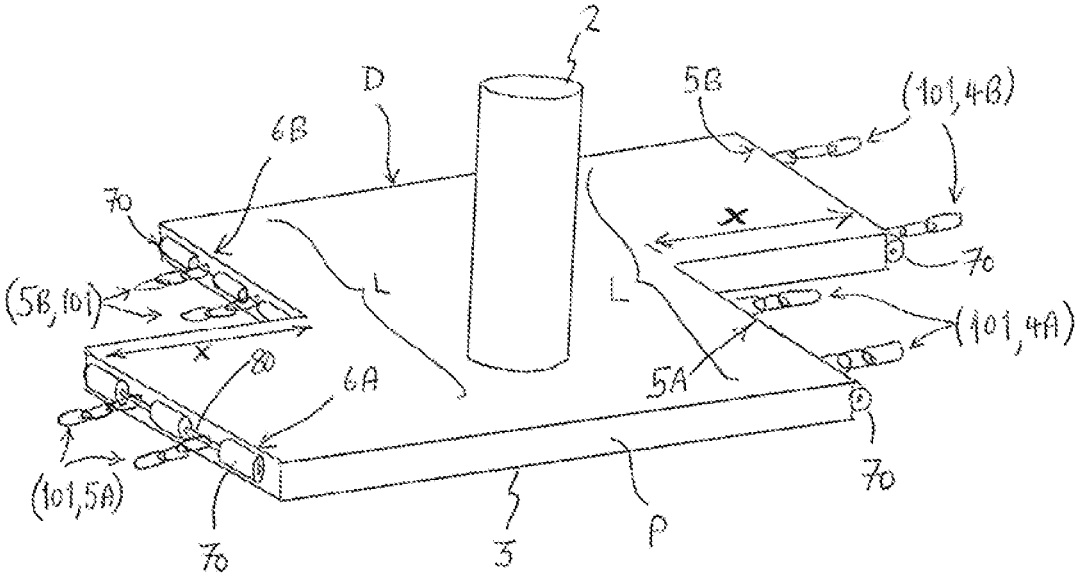
FIG. 4 shows a perspective view of a bollard apparatus according to an embodiment of the invention, whereby a barrier may be assembled by coupling together a plurality of such bollard apparatuses.

FIG. 3 shows a schematic view of various articulating coupling assemblies 4A, 4B, 40A, 40B applicable to embodiments of the invention shown in FIGS. 1, 2 and 4. These include a sequence of axially aligned bosses 70 fixed to an edge of a foot member 3, 30 in which each boss 70 presents a through-bore within which resides a coupling rod 80 connecting each boss to each other boss. A coupling link 100, 101, 102, 103 may be arranged between any two successive bosses 70 such that the coupling rod passes through a through-opening in the coupling link thereby to retain the coupling link in an articulated manner at the edge of the foot member 3, 30 upon the coupling rod and between two neighbouring bosses. The coupling link may comprise a rigid plate 100 possessing two through-openings 100A, one adjacent each end of the plate, each being configured to receive a coupling rod 80 therethrough so as to permit the plate to be coupled to two opposing edges of neighbouring foot members, as described above. Alternatively, or additionally, the coupling link may comprise a three-link length or chain 101 possessing two co-planar end links having respective link through-openings each being configured to receive a coupling rod 80 therethrough so as to permit the three-link chain to be coupled to two opposing edges of neighbouring foot members, as described above. Alternatively, or in addition, the coupling link may comprise a single loop 102, 103 possessing a through-opening configured to receive two coupling rods 80 of opposing foot members 3, 30 so as to permit the loop to be coupled to two opposing edges of neighbouring foot members, as described above. The loop 103 may possess loop opening (not shown) within the loop permitting access into the loop, and a screw-action closure part attached to the loop and adapted to be reversibly moved to open and close the loop opening as desired. This permits the loop to be attached (with the loop opening open) to the coupling rod while the coupling rod is in situ, if desired, and subsequently secured there (by closing the loop opening).

In alternative embodiments, one or each boss 70 may be replaced by a fixed loop 90 fixed to a lateral edge of the foot member 3, 30 as shown in FIG. 3, schematically. The rigid plate, chain links or loops 100, 101, 102, 103 may be attached to the fixed loop to form an articulating coupling.

FIG. 4 shows a perspective view of a bollard unit according to an embodiment of the invention, whereby a barrier may be assembled by coupling together a plurality of such bollard units.

As noted above, the lateral edge of a bollard unit may comprise intermediate portions which extend between the first and second edge parts which face the neighbouring bollard unit. The intermediate portions may be referred to as a third edge part and may extend in a direction which is aligned with the line of the barrier (e.g. parallel to the front or rear edge). The coupling assembly may be attached, at least in part, to an intermediate edge part.

Figure 5:
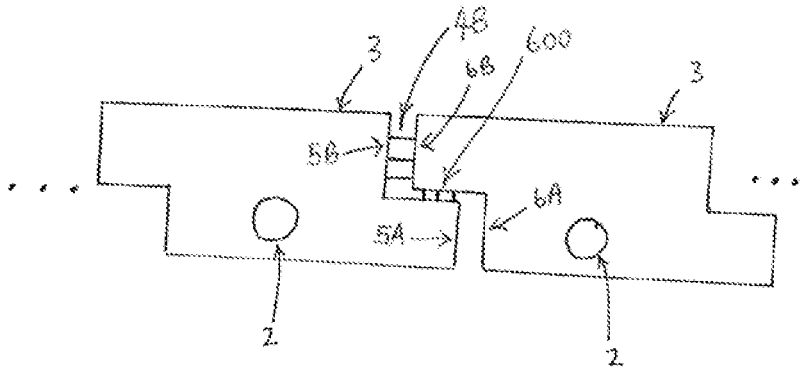
FIG. 5 shows a plan view of another example of the arrangement shown in FIG. 1 but in which the coupling assembly of the apparatus extends between neighbouring foot members at locations between the first and second edge parts of a given foot member in two perpendicular directions along the 'dog-leg' of the continuous edge containing the first and second edge parts.

Referring to FIG. 5, there is shown a plan view of another example of the arrangement shown in FIG. 1. Here, the coupling assembly 4B, 600 of the apparatus extends between neighbouring foot members 3 at locations between the first 5A and second 5B edge parts of a given foot member in two perpendicular directions along the 'dog-leg' of the continuous lateral edge containing the first and second edge parts. In particular, couplings 4B extend from the second edge 5B of one foot member to an opposing second edge 6B of a neighbouring foot member and additional couplings 600 extend from an intermediate edge part which separates the first and second edge parts 5A, 5B to an opposing intermediate edge part of the neighbouring foot member which separates the first and second edge parts 6A, 6B of that neighbouring foot member. Each foot member 3 bears a bollard member 2. It will be appreciated that the coupling assembly may additionally be provided between the second edge parts 5A and 6A, or just between the corresponding intermediate edge parts.

Figure 6:
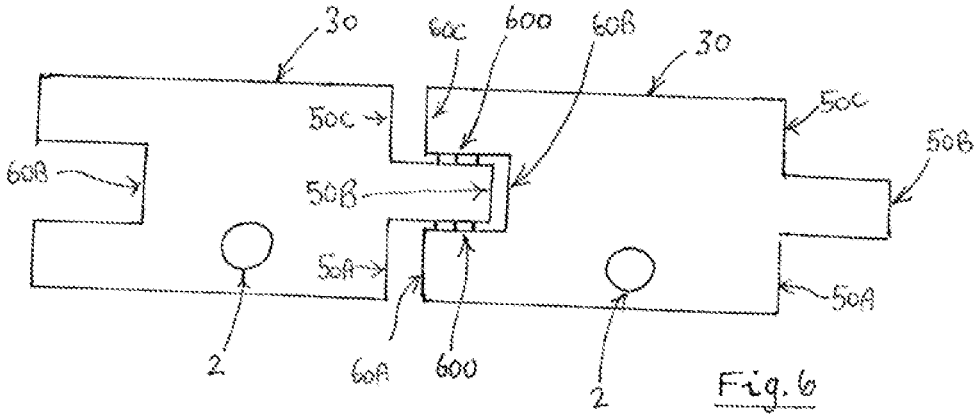
FIG. 6 shows a plan view of another example of the arrangement shown in FIG. 2 but in which the coupling assembly of the apparatus extends between neighbouring foot members at locations between the first and second edge parts of a given foot member along the 'tongue' defined by the continuous edge between the first and second edge parts.

FIG. 6 shows a plan view of another example of the arrangement shown in FIG. 2 but in which the coupling assembly of the apparatus extends between neighbouring foot members 3 at locations between the first and second edge parts of a given foot member along the 'tongue' shape defined by the continuous edge and between the first and second edge parts.

Here, the coupling assembly 600 of the apparatus extends between neighbouring foot members 3 at locations between the first 5A and second 5B edge parts of a given foot member along the 'tongue' shape contained within the continuous edge that also further contains the first and second edge parts. In particular, couplings 600 extend from an intermediate edge part which separates the first and second edge parts 50A, 50B to an opposing intermediate edge part of the neighbouring foot member which separates the first and second edge parts 60A, 60B of that neighbouring foot member. Each foot member 3 bears a bollard member 2.

The intermediate edge parts may face towards the front and/or the rear of the bollard unit.

Figure 7:
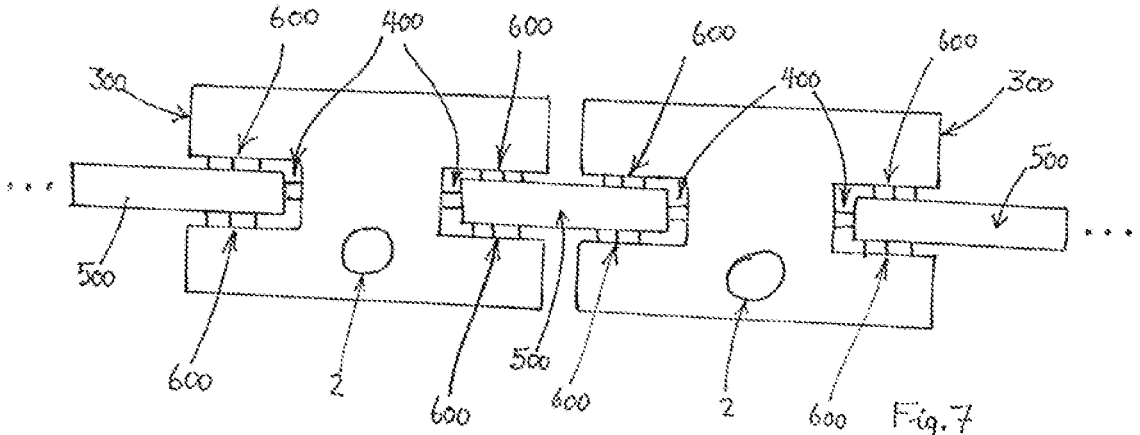
FIG. 7 shows another example of the arrangement shown in FIG. 6 but in which the assembly comprises intermediate foot members bearing no bollard member, and coupled between two neighbouring bollard-bearing foot members at opposite respective ends of the intermediate foot member.

FIG. 7 shows another example of the arrangement shown in FIG. 6 but in which the assembly comprises intermediate foot members 500 bearing no bollard member 2, and coupled between two neighbouring bollard-bearing foot members 300 at opposite respective ends of the intermediate foot member. In particular, couplings 400 extend from the second edge of one bollard-bearing foot member 300 to an opposing end edge of a neighbouring bollard-less foot member 500 and additional couplings 600 extend from an intermediate edge part of the bollard-bearing foot member 300 which separates the first and second edge parts thereof, to an opposing side edge part of the neighbouring bollard-less foot member 500 which separates the end edges that neighbouring bollard-less foot member 500.

Figure 8:
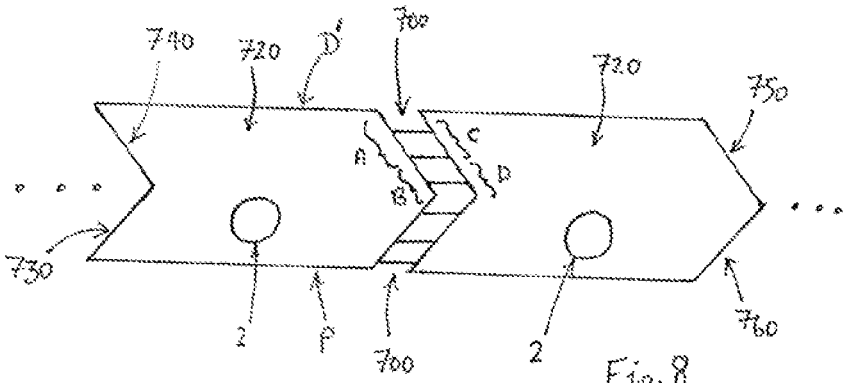
FIG. 8 shows a plan view of a vehicle impact barrier comprising foot member to which a respective bollard is fixed, in which a lateral edge of each foot member is formed into two diagonal edges which converge to a point, wherein each one of the two diagonal edges comprises a continuum of laterally offset edge parts which are offset relative to each other by virtue of the diagonal direction of the edge.

FIG. 8 shows a plan view of a vehicle impact barrier comprising foot members 720 to which a respective bollard is fixed 2, in which a lateral edge 730, 740, 750, 760 of each foot member is formed into two linear diagonal edges 750 and 760, individually; or 730 and 740 individually) which converge to a point, wherein each one of the two diagonal edges comprises a continuum of laterally offset edge parts (first part 'A' and second part 'B'; or first part 'C' and second part 'D') which are offset relative to each other by virtue of the diagonal direction of the edge. In particular, the diagonal nature of the diagonal edges is in the sense that the edges extend in a direction generally diagonal relative to the direction of the front edge P and/or the rear edge D' of the foot member in question and between which the diagonal edges extend (i.e. from the proximal edge to the distal edge). Couplings 700 extend from between neighbouring foot members from a first edge part 'A' to an opposing first edge part 'C', and from a second edge part 'B' to an opposing second edge part 'D'.

Figure 9:
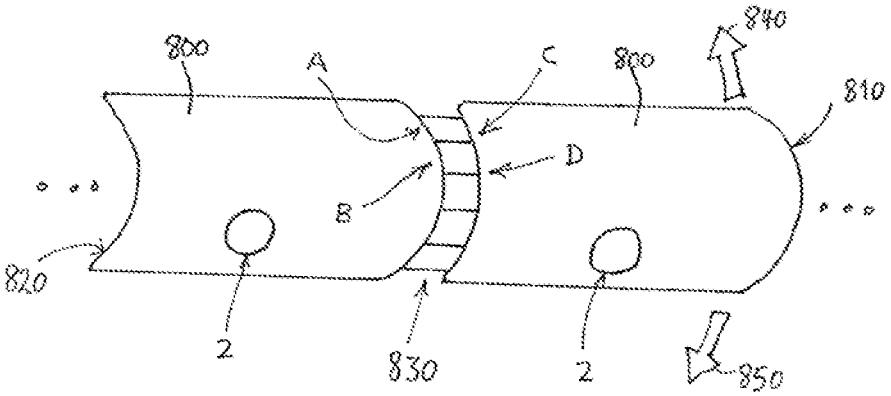
FIG. 9 shows a plan view of a vehicle impact barrier comprising foot member to which a respective bollard is fixed, in which a lateral edge of each foot member is formed into a convexly curved (e.g. circular) edge, wherein the curved edge comprises a continuum of laterally offset edge parts which are offset relative to each other by virtue of the curving direction of the edge.

FIG. 9 shows a plan view of a vehicle impact barrier comprising foot member to which a respective bollard is fixed, in which a lateral edge 810, 820 of each foot member is formed into a convexly curved (e.g. circular) edge, wherein the curved edge comprises a continuum of laterally offset edge parts which are offset relative to each other by virtue of the curving direction of the edge. A first edge part 'A' is coupled by couplings 830 to an opposing first edge part 'C', and a second edge part 'B' is coupled by couplings 830 to an opposing second edge part 'D'. This couples neighbouring foot members 800 each of which bears a bollard member 2. The curvature of the opposing edges of neighbouring foot members, between which the couplings 830 extend, permits transverse adjustment (see direction arrows 840, 850) of the orientation, in the horizontal plane of one foot member relative to a neighbouring foot member while maintaining a substantially constant separation between the opposing curved edges of those foot members, across which the couplings extend.

The above described embodiments include foot members 3 which have non-linear lateral edges when considered in plan. However, in some examples, the lateral edge may be non-planar when viewed in section. Hence, foot member 3 may comprise a plate having a thickness which extends from an in use upper surface to a lower, ground facing, surface. The thickness may be profiled to provide the laterally offset portions.

Figure 10:
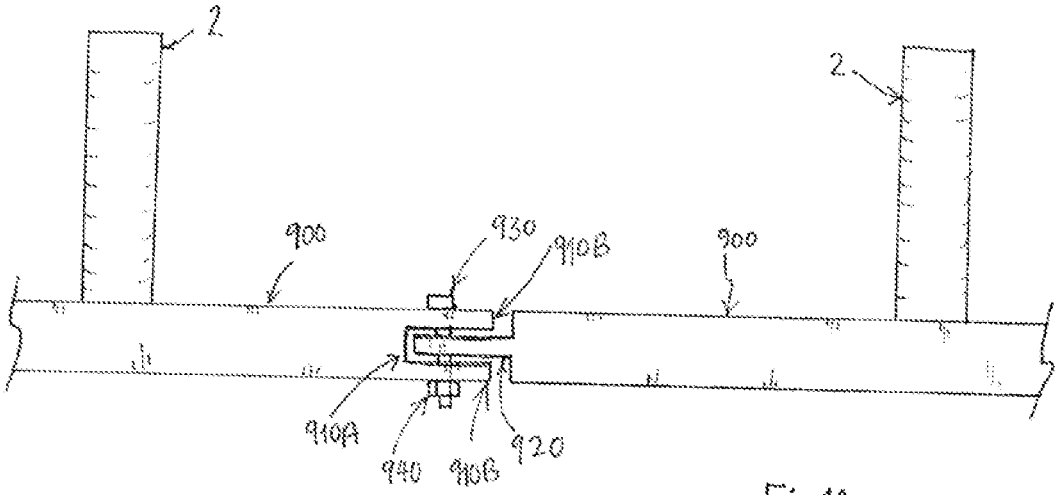
FIG. 10 shows a side view of a vehicle impact barrier (part thereof) in which the first and second edge parts of a foot member extend in a direction parallel to the longitudinal axis of a bollard of the barrier (e.g. generally vertical in use), and in which a coupling assembly of the apparatus extends (e.g. generally vertically) between neighbouring foot members.

FIG. 10 shows a side view of a vehicle impact barrier (part thereof) in which the first edge part 910A and the second edge part 910B of a foot member 900 each extend in a generally vertical direction, corresponding to a direction parallel to the longitudinal axis of a bollard 2 of the barrier. One side edge of each foot member 900 contains a groove or slot formation defined by a first groove profile edge part 910A) defining the profile of the base of the groove or slot, and a second groove profile edge part 910B defining a respective one of two sides of the mouth of the groove or slot. This profile extends in the vertical direction, and the profile persists along the side edge of the foot member along the horizontal direction. In fact, it is noted that this vertical groove/slot profile mirrors the profile of a side edge 60A, 60B, 60C seen in plan view of the foot members shown in FIGS. 2, 6 and 7.

Figure 11:
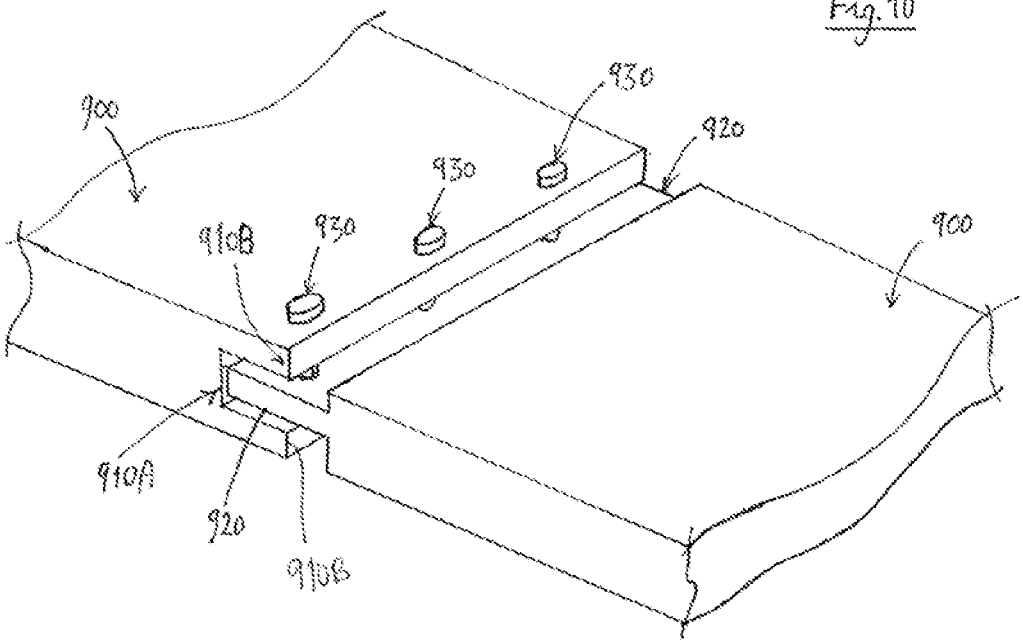
FIG. 11 shows a perspective view of a part of the barrier shown in FIG. 10.

The other side edge of each foot member 900 presents a tongue part 920 adapted to fit into the groove/slot 910A, 910B of an opposing edge of a neighbouring foot member. Holes are formed to pass through both the tongue part 920 and those parts of the groove between which the tongue resides. These holes of the groove are aligned in register with corresponding holes in the tongue. A coupling assembly of the apparatus comprises bolts 930 and securing nuts 940 attached to protruding ends of the bolts when in place in the holes to couple the foot members together. The bolts extend generally vertically between neighbouring foot members 900. FIG. 11 shows a perspective view of a part of the barrier shown in FIG. 10.

In other examples, the lateral edge may be provided with a lapped joint, for example.

The above described examples and embodiments provide a barrier comprising a linear array of bollard units. However, in some examples, it may be preferable to provide an arrangement in which adjacent bollards are angularly offset from one another.

Figure 12:
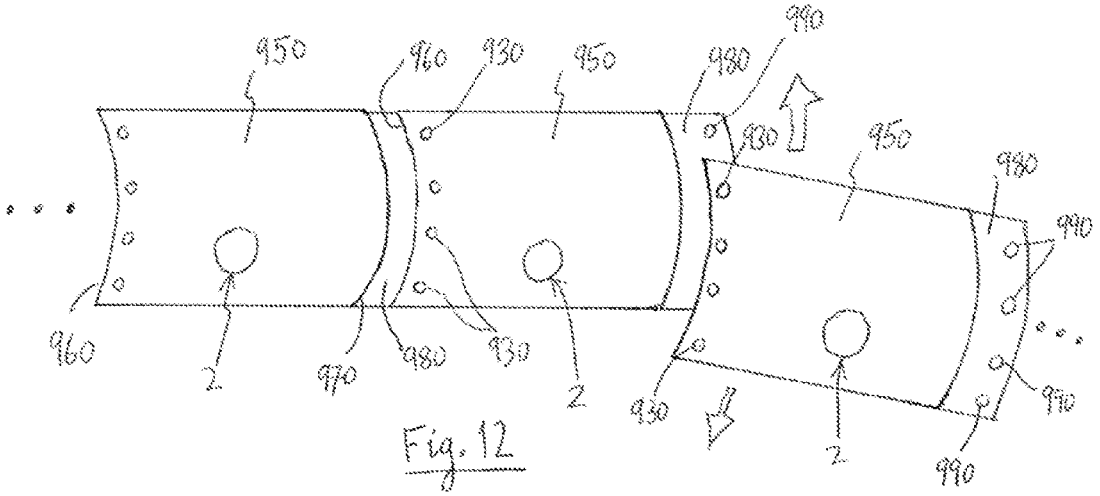
FIG. 12 shows a plan view of a variant of the vehicle impact barrier (part thereof) shown in FIGS. 9, 10 and 11, in which the first and second edge parts of a foot member extend in directions both parallel to, and transverse to (e.g. generally horizontally in use), the longitudinal axis of a bollard of the barrier (e.g. generally vertical in use), and in which a coupling assembly of the apparatus extends (e.g. generally vertically) between neighbouring foot members.

FIG. 12 shows a plan view of a variant of the vehicle impact barrier (part thereof) shown in FIGS. 9, 10 and 11, in which the first and second edge parts of a foot member 950 extend in a direction parallel to the longitudinal axis of a bollard of the barrier (i.e. generally vertical) in the tongue-and-groove arrangement described above with reference to FIGS. 10 and 11, and also extend in a direction transverse to (e.g. generally horizontally in use) the longitudinal axis of a bollard of the barrier in the manner described above with reference to FIG. 9. A coupling assembly of the apparatus extends (e.g. generally vertically) between neighbouring foot members.

In particular, FIG. 12 shows a plan view of a vehicle impact barrier (part thereof) in which the first edge part 910A and the second edge part 910B of a foot member 950 each extend in a generally vertical direction, corresponding to a direction parallel to the longitudinal axis of a bollard (2) of the barrier. One circularly, concavely curved side edge 960 of each foot member 950 contains a groove or slot formation defined by a first groove profile edge part 910A defining the profile of the base of the groove or slot, and a second groove profile edge part 910B defining a respective one of two sides of the mouth of the groove or slot. This profile extends in the vertical direction, and the profile persists along the circularly, concavely curved side edge of the foot member along the horizontal direction. In fact, it is noted that this vertical groove/slot profile mirrors the profile of a side edge 60A, 60B, 60C seen in plan view of the foot members shown in FIGS. 2,6 and 7.

Figure 13:
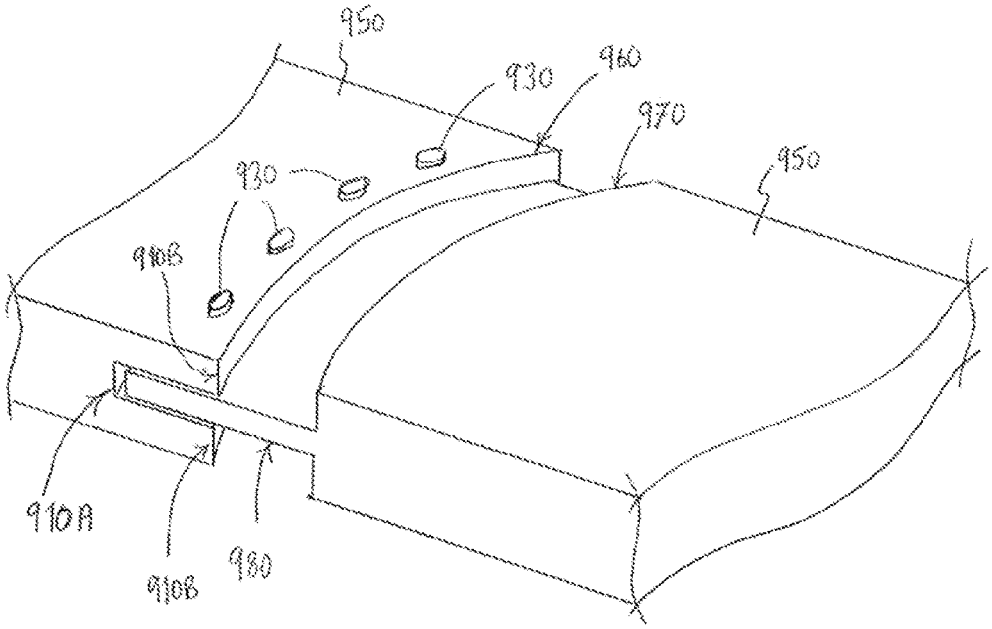
FIG. 13 shows a perspective view of a part of the barrier shown in FIG. 12.

The other circularly, convexly curved side edge 970 of each foot member 950 presents a tongue part 980 adapted to fit into the groove/slot 910A, 910B of an opposing circularly, concavely curved edge of a neighbouring foot member. Holes are formed to pass through both the tongue part 980 and those parts of the groove between which the tongue resides. These holes of the groove are aligned in register with corresponding holes in the tongue. A coupling assembly of the apparatus comprises bolts 930 and securing nuts (not shown, see 940) attached to protruding ends of the bolts when in place in the holes to couple the foot members together. The bolts extend generally vertically between neighbouring foot members 950. FIG. 13 shows a perspective view of a part of the barrier shown in FIG. 12. The arrangement of holes in the respective foot members allows the adjacent neighbouring foot members to be mounted at an angle to the corresponding which the coupling is configured to couple the foot member and neighbouring foot member in one of a plurality of discrete positions. Thus, there may be provided a bollard apparatus in which each of the plurality of discrete positions provides a different angle of alignment between the foot member and the neighbouring foot member, such that the profile of the barrier line can be adjusted to suit a required, curved, barrier line.

It will be understood that the invention is not limited to the examples and embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A bollard apparatus for use as a vehicle barrier, comprising:

a plurality of bollard members;

a plurality of foot members that are separate from each other and are each adapted for ground engagement by placement upon or embedment within a ground or floor surface, one or more of the plurality of foot members being attached to at least one bollard member of said plurality of bollard members upstanding therefrom, wherein each of said plurality of foot members comprises:

a front edge;

a rear edge; and at least one lateral edge which opposes and interleaves with a corresponding lateral edge of a neighbouring foot member of the plurality of foot members, wherein the at least one lateral edge extends between the front edge and the rear edge and is non-planar so as to comprise a first edge part and a second edge part that is laterally offset from the first edge part, wherein a profile of the lateral edge is the inverse of a profile of the corresponding lateral edge of the neighbouring foot member; and a coupling assembly forming an articulating coupling which couples a first foot member of the plurality of foot members to a neighbouring foot member of the plurality of foot members in an articulating manner, wherein the coupling assembly is attached to opposing lateral edges of the first foot member and the neighbouring foot members, wherein the first edge part of each of the first foot member and the neighbouring foot member are laterally offset from the respective second edge part of the first foot member and the neighbouring foot member by a lateral offset exceeding the maximum separation between the opposing lateral edges permitted by the articulating coupling.

2. A bollard apparatus according to claim 1, wherein the at least one lateral edge defines a line between the first foot member and the neighbouring foot member and the line is non-linear.

3. A bollard apparatus according to claim 1, wherein the at least one lateral edge has a curved or stepped profile.

4. A bollard apparatus according to claim 3, wherein the at least one lateral edge is stepped along a length between the front and rear edges and/or wherein each foot member comprises a thickness and the at least one edge is stepped across the thickness of that foot member.

5. A bollard apparatus according to claim 1, wherein the lateral edge of the first foot member forms a tongue and groove arrangement with corresponding lateral edge of the neighbouring foot member.

6. A bollard apparatus according to claim 1, wherein the at least one lateral edge comprises a third edge part which extends between the first edge part and second edge part, wherein the coupling is attached to the third edge part.

7. A bollard apparatus according to claim 6, wherein the third edge part extends in the same direction as the front or rear edge.

8. A bollard apparatus according to claim 7, wherein the coupling assembly, which is configured to permit articulation of one of the first foot member relative to the neighbouring foot member or the neighbouring foot member relative to the first foot member, comprises a plurality of couplings which pass through the thickness of the first foot member and the neighbouring member, wherein the first foot member is spaced apart from the neighbouring foot member in a first direction coincident with the thicknesses of the first foot member and the neighbouring foot member to permit articulation in the first direction.

9. A bollard apparatus according to claim 1, wherein the coupling assembly is configured to couple the first foot member and the neighbouring foot member in one of a plurality of discrete positions.

10. A bollard apparatus according to claim 9, wherein each of the plurality of discrete positions provides a different angle of alignment between the first foot member and the neighbouring foot member.

11. A bollard apparatus according to claim 1, wherein the first edge part and second edge part are orthogonally arranged.

12. A bollard apparatus according to claim 1, wherein at least one foot member comprises a plate, wherein the lateral edge comprises a peripheral edge of the plate.

13. A bollard apparatus according to claim 1, wherein the rear edge of the first foot member comprises an extension which projects rearwards beyond a rear edge of the neighbouring foot plate.

14. A bollard apparatus according to claim 1, comprising a plurality of separate coupling assemblies each forming an articulating coupling between the first foot member and the neighbouring foot member whereby, by said articulating coupling, each said foot member is coupled:

at a first edge part thereof to an opposing first edge part of the neighbouring foot member such that said first edge parts define a first pair of coupled opposing edge parts;

at a second edge part thereof to an opposing second edge part of the neighbouring foot member such that said second edge parts define a second pair of coupled opposing edge parts, wherein the first pair of coupled opposing edge parts is laterally offset from the second pair of coupled opposing edge parts in a direction transverse to the direction in which a said first edge part extends.

15. A bollard apparatus according to claim 1, wherein the coupling assembly comprises two terminal ends, and each of the two terminal ends is attached to a respective one of the opposing lateral edges.

16. A bollard apparatus according to claim 1, wherein the at least one lateral edge is formed into two diagonal edges which converge to a point, and wherein one of the diagonal edges comprises a continuum of laterally offset edge parts including the first edge part and the second edge part.

17. A bollard apparatus according to claim 1, wherein the at least one lateral edge is formed into a curved edge, and wherein curved edge comprises a continuum of laterally offset edge parts including the first edge part and the second edge part.

18. A bollard apparatus according to claim 1, wherein the front edge of each of at least one foot member is substantially parallel to the rear edge of that at least one foot member.

19. A bollard apparatus according to claim 1, wherein the coupling assembly comprises a chain consisting of three links.

20. A bollard apparatus according to claim 19, wherein the coupling assembly further comprises:

a respective sequence of bosses fixed to the opposing lateral edges of each of the first foot member and the neighbouring foot member, wherein each sequence of bosses comprises a plurality of bosses, each boss of the plurality of bosses having a through-bore; and a respective coupling rod connecting each boss within each of the sequences of bosses, each coupling rod residing within the through-bores of each sequence of bosses, wherein a first coupling rod is received within a first link of the chain, a second coupling rod is received within a second link of the chain and wherein the first link and the second link are at opposite ends of the chain.

* * * * *